US005630432A

United States Patent [19]

Gaudlitz et al.

[11] Patent Number: 5,630,432

[45] Date of Patent: May 20, 1997

[54] DROPLET JET APPLICATION OF ADHESIVE TO CIGARETTE ENDS

[76] Inventors: Robert T. Gaudlitz, 4661 Melody Ct., Richmond, Va. 23234; Hugh J. McCafferty, II, 2811 Bosham La., Midlothian, Va. 23113; James M. Washington, 2400 Stuts La., Richmond, Va. 23236

[21] Appl. No.: 246,768

[22] Filed: Sep. 20, 1988

[51] Int. Cl.[6] ..... A24C 5/60

[52] U.S. Cl. ..... 131/284; 131/69

[58] Field of Search ..... 131/35, 37, 69, 131/90, 284; 239/3, 706, 690

[56] References Cited

U.S. PATENT DOCUMENTS

| | | |
|---|---|---|
| 126,698 | 5/1872 | Harris . |
| 556,218 | 3/1896 | Sondheim . |
| 1,013,825 | 1/1912 | Sondheim . |
| 1,282,014 | 10/1918 | Krummling . |
| 2,030,319 | 2/1936 | Rambert . |
| 2,149,896 | 3/1939 | McArdle et al. . |
| 2,190,107 | 2/1940 | Pohle . |
| 2,217,527 | 10/1940 | Roon . |
| 2,218,071 | 10/1940 | Pohle . |
| 2,543,277 | 2/1951 | Copeman . |
| 2,849,005 | 8/1958 | Tucker et al. . |
| 2,923,034 | 2/1960 | Dickie et al. . |
| 3,040,752 | 6/1962 | Ganz . |
| 3,046,995 | 7/1962 | Christy . |
| 3,281,860 | 10/1966 | Adams et al. . |
| 3,373,437 | 3/1968 | Sweet et al. . |
| 3,465,350 | 9/1969 | Keur et al. . |
| 3,465,351 | 9/1969 | Keur et al. . |
| 3,485,208 | 12/1969 | Hemming et al. . |
| 3,512,172 | 5/1970 | Colecchi . |
| 3,525,343 | 8/1970 | Wiles, Jr. . |
| 3,562,757 | 2/1971 | Bischoff . |
| 3,579,245 | 5/1971 | Berry . |
| 3,596,275 | 7/1971 | Sweet . |
| 3,683,396 | 8/1972 | Keur et al. . |
| 3,687,705 | 8/1972 | Kilbane . |
| 3,708,118 | 1/1973 | Keur . |
| 3,930,258 | 12/1975 | Dick et al. . |
| 4,023,182 | 5/1977 | Arway et al. . |
| 4,067,020 | 1/1978 | Arway . |
| 4,121,222 | 10/1978 | Diebold et al. . |
| 4,488,665 | 12/1984 | Cocks et al. . |
| 4,776,351 | 10/1988 | Wahle et al. ..... 131/69 |
| 4,785,831 | 11/1988 | Hinchcliffe et al. . |

FOREIGN PATENT DOCUMENTS

| | | |
|---|---|---|
| 2163339 | 2/1986 | United Kingdom . |
| 2180180 | 4/1987 | United Kingdom . |

*Primary Examiner*—Jennifer Bahr

*Attorney, Agent, or Firm*—James T. Moore; James E. Schardt; Charles E. B. Glenn

[57] ABSTRACT

A method and apparatus are provided for applying an adhesive solution to the coal end of a cigarette by means of a precisely controlled liquid jet spray to bond shreds of tobacco in the cigarette end and to thereby reduce the amount of tobacco which falls out of the cigarette when shaken. Electronic controls are employed to synchronize the formation and charging of a series of droplets which are deflected in prescribed paths to contact the coal end of the cigarette in a predetermined pattern. Circuits are provided to adjust the timing and phase of the charging mechanism to compensate for variations in the speed at which the cigarette is conveyed to a target area and for variations in the timing of droplet formation.

11 Claims, 5 Drawing Sheets

125

400
400a
400b
401
402
404
406
410
412
412a
413
414
414a
414b
415
+V
EN4
EN3
416
416a
416b
417
418
418a
418b
420
420a
420b
422
422a
422b
424
426
428
430
432
434
436
438
438a
438b
EN1 EN2 EN3 EN4
CK
CK'
414
442
440
444
START PATTERN
121
123
124

111
TO CHARGING TUNNEL 112
FROM CHARGE PICKUP ELECTRODE 136
324
470
474
486
468
484
464a
464
A0
A1
A2
A3
A4
A5
A6
A7
482
451
450
450a
450b
CK'
478
476
460
462
488
MAKE TEST DROPS
461
461
480
452
150a
150b
150c
150d
150
START PATTERN

DROPLET JET APPLICATION OF ADHESIVE TO CIGARETTE ENDS

BACKGROUND OF THE INVENTION

The present invention relates to a method and apparatus for bonding tobacco shreds at the end of a cigarette.

During the handling, packaging and shipping of a production cigarette, tobacco particles typically shake loose from the coal end of the cigarette and fall out of the cigarette. Some of these loose particles fall into the cigarette pack, resulting in an unsightly product. Also, after the cigarette pack is opened by the consumer, loose particles may fall out of the pack into the consumer's purse or pocket, causing consumer dissatisfaction. Avoiding the loss of tobacco is particularly problematical for cigarettes which are made at lower than standard densities.

SUMMARY OF THE INVENTION

It is therefore an object of the present invention to provide a method and apparatus for applying a binding agent to the tobacco shreds at the coal end of a cigarette to bind the tobacco shreds and thereby significantly reduce tobacco loss.

It is a further object of the present invention to provide a method and apparatus for applying the binding agent to cigarettes as those cigarettes are produced on a cigarette maker and tipping machine.

These and other objects of the present invention are accomplished by a method and apparatus in which a binding agent is diluted in an electrically conductive solution in a small pressure vessel and forced with a constant pneumatic pressure through a nozzle. The nozzle is surrounded by piezoelectric crystals which are electrically driven to cause pressure surges in the fluid as it exits the nozzle. The fluid stream breaks into droplets of predetermined size, spacing, velocity, and direction. As the droplets form from the emerging stream, some are charged by a charging electrode to which a controlled voltage is applied. The charged droplets are then deflected as they pass between charged plates at an acceleration which is a function of the charge on the droplets. Uncharged droplets and droplets charged with a low voltage are recycled. Strongly deflected droplets contact the end of a cigarette in a pattern to cause the end of the cigarette to be sufficiently covered with adhesive solution to bind together the tobacco shreds at the end of the cigarette. The cigarette end is coated as the cigarette is produced on a cigarette maker and tipping machine.

The machine includes a cigarette drum around the circumference of which is located a series of grooves adapted for holding cigarettes. During production, cigarettes are placed in the grooves and the cigarette drum is caused to rotate. The spraying process of the present invention is performed as the cigarettes pass a predetermined target location during rotation of the cigarette drum. Electronic controls responsive to the rotational speed of the drum are employed to drive the charging electrode. A droplet pattern is generated by selectively charging certain droplets to different charge values after a cigarette has been detected in a groove of the drum. The timing of the charging process is adjusted to compensate for missing cigarettes and for variations in the speed of the drum.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
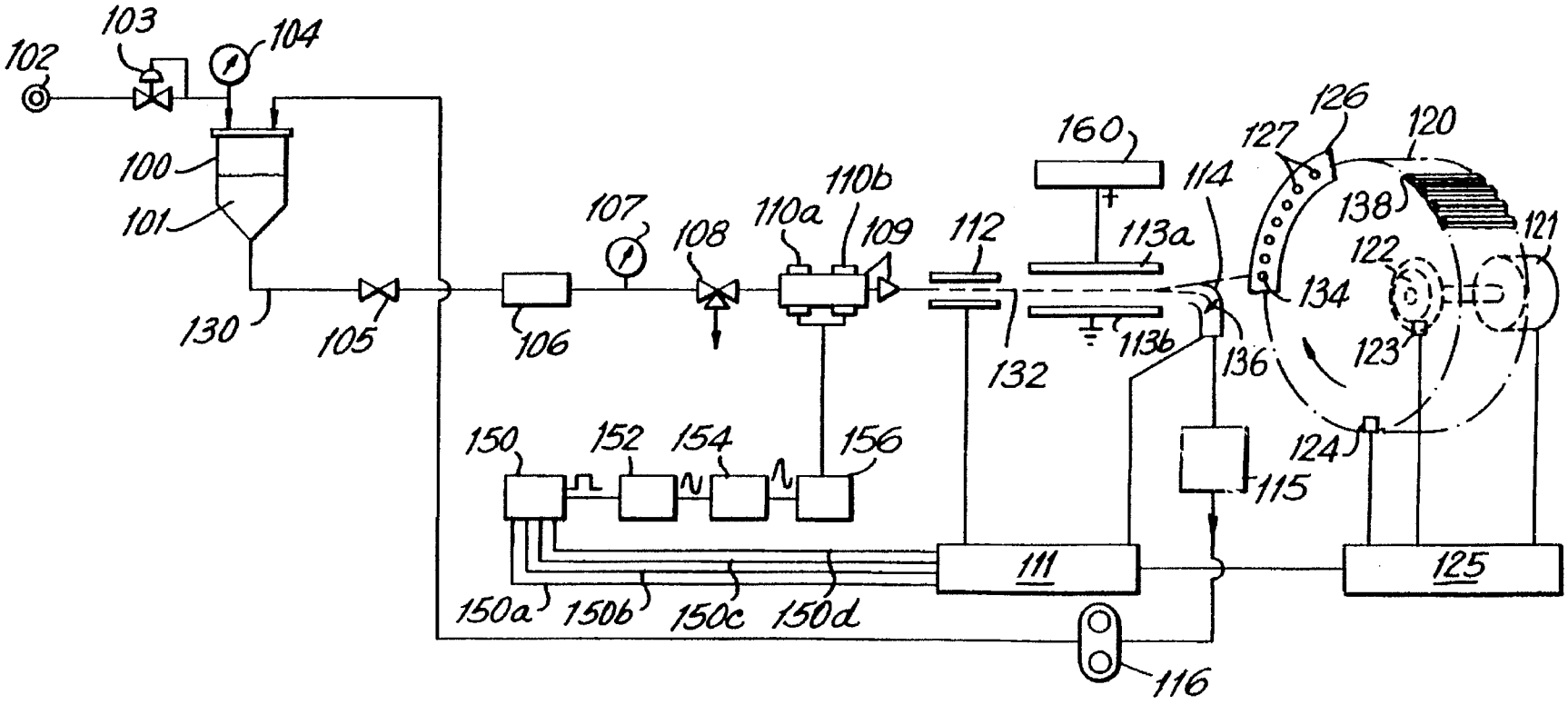
FIG. 1 is a schematic diagram of an apparatus in accordance with the present invention.

Referring to FIG. 1, which shows a schematic diagram of an apparatus in accordance with the present invention, tank 100 is a conventional pressure tank which serves as a reservoir for adhesive solution 101 to be sprayed on the cigarettes on cigarette drum 120.

The adhesive solution includes a soluble binding agent which, when dry, binds the tobacco shreds at the coal end of each cigarette together. Preferably, known binders such as corn syrup and polydextrose are used. The binder is diluted to achieve a desirable viscosity and to control the amount of binder applied to each cigarette. For example, a typical solution may comprise corn syrup having a 36 to 62DE (dextrose equivalent) diluted with water to a concentration in the range of 14 to 60% solids. Other types of adhesive solutions also may be used, including those comprising modified corn syrups.

The adhesive solution also includes an electrolyte that permits droplets of the solution to accept an electric charge. Preferably, the electrolyte gives the adhesive solution a conductivity in the range of 2–10 millimhos per centimeter. A salt such as potassium chloride or sodium chloride may be added to the solution to achieve the desired conductivity. The composition of the adhesive solution preferably is such that the fluid is a Newtonian fluid having a surface tension in the range of 60–70 dynes/cm$^2$. Although non-Newtonian fluids may also be used, the stable viscosity of a Newtonian fluid is preferable because it reduces the occurrence of irregular satellite droplets.

Tank 100 is pressurized by air supply 102. The pressure in tank 100 is controlled by a conventional pressure controller 103. Preferably, tank 100 is pressurized to a pressure within the range of 20 to 80 psig as measured by conventional pressure gauge 104. The pressure in tank 100 causes adhesive solution 101 to pass from tank 100 into tubing 130 through a conventional shut-off valve 105. Tubing 130 may be tubing of conventional construction that is capable of transporting the adhesive solution under pressure. Preferably, tubing 130 has an inside diameter of approximately 0.09–0.20 inch to permit the adhesive solution, which typically has a viscosity in the range of 15–60 centipoise, to flow smoothly through the tubing during operation.

Tubing 130 directs the adhesive solution through filter 106, which removes particles from the solution that might interfere with proper fluid flow and cause clogging in the system. Filter 106 may be of conventional design, and may be, for example, of the replaceable element type or the cleanable type. Preferably, filter 106 is adapted to remove all particles having a diameter greater than 5 percent of the diameter of the orifice of jet 109, described below. For long term continuous operation, two filters may be installed in a parallel arrangement to permit adhesive solution to flow through one while the other is cleaned.

The need for a pressure tank and air pressure supply components may be eliminated by using a conventional positive displacement pump such as a gear pump at a position downstream of valve 105 to supply the adhesive solution under pressure.

The pressure of adhesive solution in tubing 130 is measured by pressure gauge 107. Tubing 130 provides the pressurized adhesive solution to drain valve 108. On start-up of the system, any air which is trapped in tubing 130 is forced out of drain valve 108 with some adhesive solution and is drained away. The adhesive solution then passes through jet 109 and is discharged by jet 109 as a pressurized stream. Piezoelectric crystals 110*a* and 110*b* surround jet 109 and are electrically driven in response to a clock signal generated by master clock 150. Master clock 150 generates a square wave clock signal having a frequency equal to the desired droplet frequency. Typically, this frequency is in the range of 5–20 KHz The clock signal is converted into a sine wave signal by a conventional low pass filter circuit 152, and is amplified by power amplifier 154 and step-up transformer 156 to provide a high voltage sine wave drive signal at the droplet generation frequency to piezoelectric crystals 110*a* and 110*b*. This drive signal causes piezoelectric crystals 110*a* and 110*b* to vibrate at the droplet generation frequency, and thereby to introduce pressure variations in the stream of adhesive solution discharging from jet 109. The pressure variations introduced by the vibrations of piezoelectric crystals 110*a* and 110*b* cause the stream of adhesive solution to break up into a series of droplets 132 having a predetermined size, spacing, velocity and direction, depending on the viscosity and pressure of the adhesive solution, the vibrational frequency of piezoelectric crystal 110*a* and 110*b* and the design of jet 109.

The pressurized stream of adhesive solution is directed into a charging tunnel 112 to which a series of controlled voltage signals is applied by jet control circuit 111 in synchronization with the clock signal generated by master clock 150. As described above, the adhesive solution contains an electrolyte which makes the solution electrically conductive. Therefore, as the stream passes into charging tunnel 112, an electric current is induced in the stream having a magnitude which is a function of the magnitude of the voltage applied to tunnel 112. Individual droplets break off the end of the stream while in charging tunnel 112, retaining a charge proportional to the voltage of charging tunnel 112 at the moment of break-off. The exact timing and location of break-off may vary gradually among the droplets. The timing of droplet formation can thus drift out of phase with respect to the drive signal being applied to the piezoelectric crystals, such that voltage signals applied to charging tunnel 112 in phase with the piezoelectric crystal drive signal do not properly charge the droplets. To compensate, the timing of the voltage signals applied to charging tunnel 112 is adjusted. This is accomplished as follows. Master clock 150 generates four clock signal outputs at the droplet generation frequency in addition to the clock signal used to drive piezoelectric crystals 110*a* and 110*b*. The clock signal on output line 150*a* is in phase with the drive signal applied to piezoelectric crystals 110*a* and 110*b*. The clock signals on output lines 150*b*, 150*c* and 150*d* differ in phase from the clock signal on output line 150*a* by 90°, 180° and 270°, respectively. One of the four phases is selected by jet control electronics 111 to synchronize the voltage signals applied to charging tunnel 112. As described in greater detail below, test voltages are periodically applied to charging tunnel 112 to detect phases that result in poorly charged droplets. If a bad phase is detected jet control electronics 111 selects a phase 180° away from the bad phase, and uses that phase to time the voltage signals applied to charging tunnel 112.

The droplets exit from charging tunnel 112 and pass between a pair of deflection plates 113*a* and 113*b*. A voltage differential is applied to deflection plates 113*a* and 113*b* by conventional power supply 160 to cause charged droplets passing between the plates to be accelerated in proportion to the magnitude of the charge on the droplets. The charged droplets have a negative charge, and are accelerated toward the positive plate on a path prescribed by the electric field between the plates. Droplets which are charged properly continue past gutter 114 toward a predetermined target area 134. Droplets which are uncharged or insufficiently charged are collected in gutter 114.

The adhesive solution collected by gutter 114 is typically foamy. This foam should be removed from the solution during recycling to ensure proper droplet formation upon reuse. Thus, droplets collected by gutter 114 are passed to degassing tank 115 to remove any gas from the collected adhesive solution. Degassing may be accomplished using conventional degassing techniques, including such techniques as ultrasonic and centrifugal degassing. The adhesive solution is then returned for reuse to tank 100 by pump 116.

Gutter 114 serves an important second function. To test whether the droplet charging voltages are coincident with the formation of droplets, test droplets are generated and charged with a small charge which is not large enough to cause the test droplets to clear gutter 114. The test droplets are caused to strike a charge pickup electrode 136 in gutter 114 which results in an electric current being generated. The magnitude of the current, which is related to the charge on the droplets, is compared to a reference value indicative of properly charged droplets. If that magnitude is below the reference value, then a phase differential exists between the timing of charging voltages and droplet formation which is causing droplets to be poorly charged. In such a circumstance, jet control electronics 111 changes the phase of the clock signal used to time the application of voltage signals to charging tunnel 112 by 180°, in the manner described above.

Figure 2:
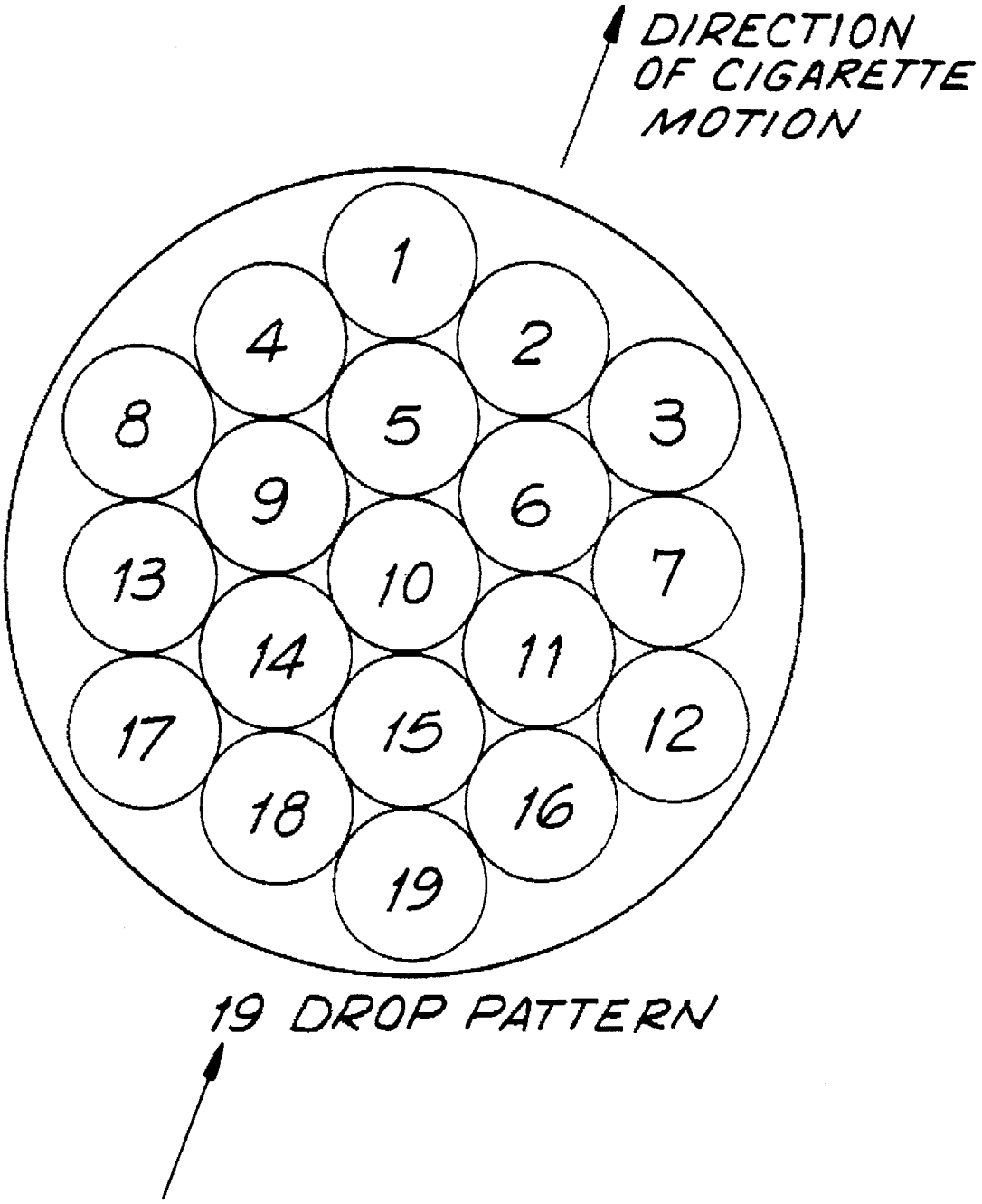
FIG. 2 is a diagram of a preferred pattern of droplets superimposed over the end of a cigarette.

Droplets which are deflected away from gutter 114 are used to bind the tobacco in the coal end of cigarettes that pass through target area 134. The droplets are charged in such a manner as to cause the droplets to contact the coal end of a cigarette in a predetermined pattern covering a substantial portion of the cigarette end. FIG. 2 shows a preferred pattern containing 19 droplets. Of course, other patterns of droplets, including square patterns, may be used as well.

The pattern shown in FIG. 2 is created by charging and deflecting the droplets to vary the height at which each droplet approaches target area 134. In this manner, a column of droplets can be caused to contact a cigarette in target area 134. By moving the cigarette across target area 134, and properly timing the droplet charging voltages with that movement to selectively charge a number of droplets, consecutive columns of varying lengths can be applied to the cigarette to form the solid circular pattern shown in FIG. 2.

Cigarettes are conveyed to target area 134 by cigarette drum 120, around the periphery of which are located a number of grooves 138 in which the cigarettes are positioned. Cigarette drum 120 is a conventional cigarette drum of the type found in commercial cigarette maker and tipping machines. Such drums typically operate at various speeds during a production run. Changes in speed may be caused by several factors. For example, at the beginning of a production run, the drum is accelerated from rest, and at the end of the run, or when a fault condition occurs, the drum is decelerated. Fluctuations in speed may also be caused by variations in the load on, or voltage supplied to, the motor driving the drum. Such changes in drum speed vary the frequency and speed at which cigarettes pass through target area 134. To compensate for these changes, a set of electrical controls responsive to the rotational speed of the drum is employed to time the application of voltage signals to charging tunnel 112. Drum 120 is fitted with a conventional optical encoder 121 which generates electrical signals to measure incremental changes in the position of drum 120. Slotted disk 122 is provided on drum 120 having slots which are aligned with corresponding grooves on the periphery of drum 120. Optical sensors 123 and 124 respectively sense slot position and the presence or absence of a cigarette on a groove of drum 120 as drum 120 rotates. As discussed below, timing control electronics 125 combine the sensor information provided by optical encoder 121 and sensors 123 and 124 to call for the proper droplet patterns from jet control circuit 111.

Cigarette drum 120 may be fitted with a mask 126 with holes 127 directly aligned with the cigarette ends to ensure that no droplets strike the cigarettes outside the prescribed position, and to ensure that no droplets strike the edges of the grooves and foul the drum.

It is of course to be appreciated by a person of skill in the art that the spraying process of the present invention is not limited to spraying cigarettes on a cigarette drum of the type described herein. It is an advantage of the present invention that a small amount of adhesive solution can be applied with precision to cigarettes travelling at high speeds on other types of conveyance means as well.

Figure 3:
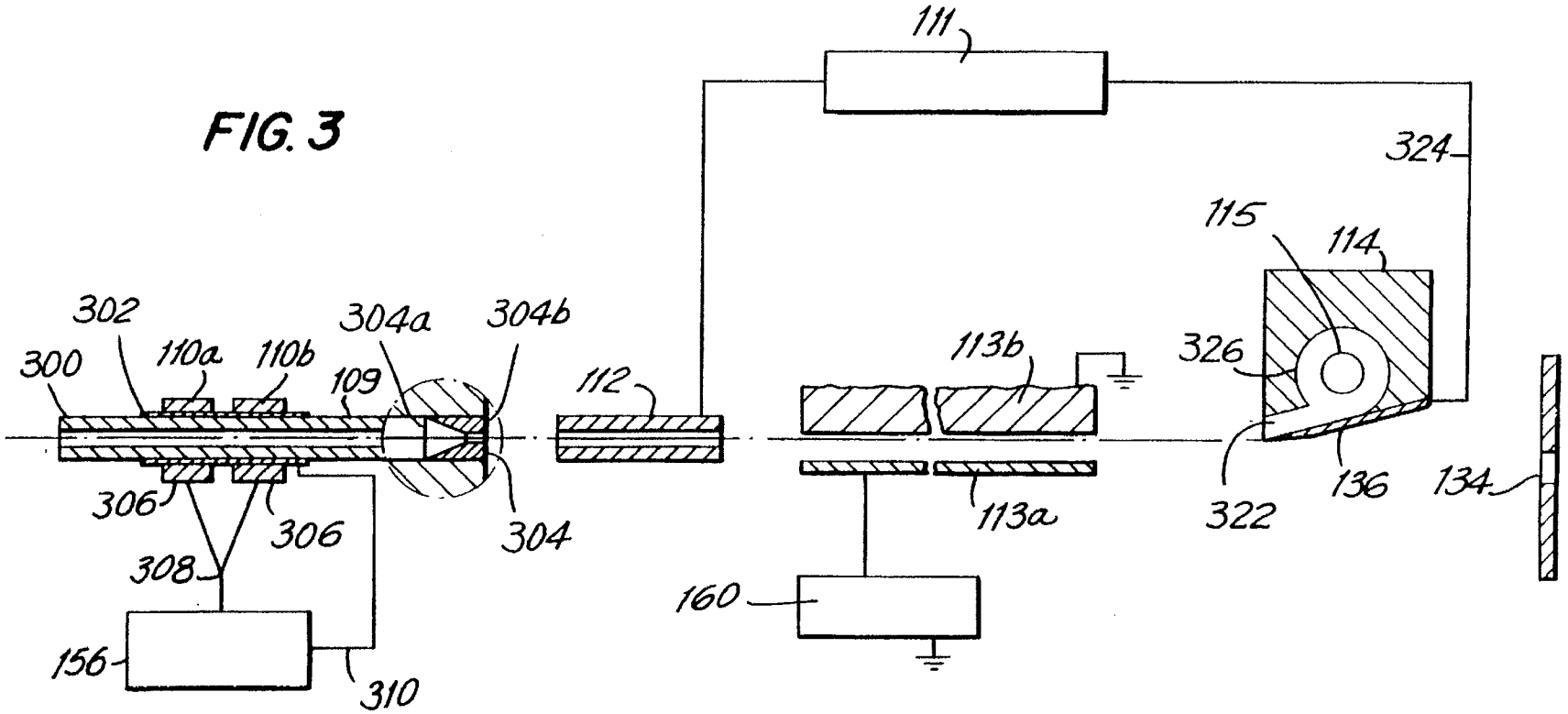
FIG. 3 is a section view drawing of jet 109, piezoelectric crystals 110*a* and 110*b*, charging tunnel 112, deflection plates 113*a* and 113*b* and gutter 114 of FIG. 1.

Referring now to FIG. 3, preferred embodiments of jet 109, piezoelectric crystals 110*a* and 110*b*, charging tunnel 112, deflection plates 113*a* and 113*b* and gutter 114 are illustrated. Jet 109 comprises glass tube 300, silver sleeve 302 and sapphire nozzle 304. Glass tube 300 is hollow, having an outside diameter of approximately 0.25 inch and an inside diameter of approximately 0.087 inch, and is approximately 2.25 inches long. Glass tube 300 is connected at one end to tubing 130 (not shown) to receive pressurized adhesive solution from tank 100. Sapphire nozzle 304, having an outside diameter equal to the inside diameter of glass tube 300, is fitted and glued into the other end of glass tube 300. Nozzle 304 has a round orifice 306 formed therein that is concentric with nozzle 304 and glass tube 300. Orifice 306 has an inner portion shaped by inwardly sloping walls extending from the inner surface 304*a* of nozzle 304 to approximately 0.0145 inch from the outer surface 304*b* of nozzle 304. The outer portion of orifice 306 is shaped by walls having a constant diameter of approximately 0.0145 inch, and extends between the inner portion of orifice 306 and the outer surface 304*b* of nozzle 304. Nozzle 304 is made preferably of sapphire because that material does not easily erode and can be shaped with precision, although other materials, such as drawn quartz, may also be used.

The diameter of orifice 306, a typical value for which has been set forth above, may be chosen using the following guidelines. First, it should be large enough to form droplets of a size that will result in the desired amount of solid binding agent being applied to a cigarette. For example, if it is desired that at least 2 milligrams of solid binding agent be applied to each cigarette, and that the binding agent is to be diluted in an adhesive solution having 650 grams of solid mass per liter of solution, then at least 3.07 microliters of adhesive solution is to be applied to each cigarette. For a 19 droplet pattern, such as that shown in FIG. 2, each droplet therefore should have a volume of at least 0.167 microliters. The volume of the droplet is related to its diameter, which in turn is a function of the diameter of orifice 306. It may thus be seen that the desired droplet volume for a particular pattern can determine a minimum diameter for orifice 306.

Orifice 306 also should be large enough to provide a greater volume of fluid for each cigarette than is necessary to form the exact number of droplets in a desired pattern, because certain droplets may not be usable in the pattern. For example, the 19 droplet pattern shown in FIG. 2 comprises 5 columns of droplets. The columns are spaced apart from one another to provide a substantially even distribution of binding agent over the end surface of the cigarette. If, after a column is applied to a cigarette, the cigarette does not move in a direction perpendicular to the column, then subsequent droplets directed to form the next column will recoat the surface covered by the first column. For this reason, jet control electronics 111 includes circuitry to prevent the charging of droplets which are generated at a time such that they will reach the cigarette after a column has been completed, but before the cigarette is in the proper position to begin a new column. Such droplets are collected by gutter 114. The number of unused droplets depends on the droplet frequency and the speed at which cigarettes pass through target area 134. If, for a given droplet frequency and drum speed, only 20 percent of the generated droplets are usable, then 5 times the volume of adhesive solution applied to a cigarette should flow through orifice 306 for each cigarette that enters target area 134. This establishes a desired rate of fluid flow through orifice 306.

The rate of fluid flow through orifice 306 is, in turn, a function of the diameter of the orifice and the velocity of the droplets. There can be a limit on the maximum velocity of the droplets that may impose a minimum on the diameter of orifice 306. For example, a limit on droplet velocity may result from the requirement that the droplets spend a certain amount of time between deflection plates 113*a* and 113*b* to cause proper deflection of the droplets. The length of deflection plates 113*a* and 113*b* can be extended to achieve the desired deflection at higher velocities, but the increased distance over which the droplets travel increases the degree to which air turbulence in the path of the droplets causes undesirable variations in the flow of the droplets and decreases the accuracy with which the droplets are positioned. The intensity of the electric field between deflection plates 113*a* and 113*b* also can be increased to obtain the desired deflection, but is limited by the breakdown voltage of the air gap between the plates. Thus, limitations imposed on droplet velocity, and on the length and field strength of deflection plates 113*a* and 113*b*, can determine a minimum diameter for achieving a desired fluid flow rate.

Another factor to be considered is the frequency at which droplets are generated. For a given type of adhesive solution and a given fluid flow rate, there exists a range of frequencies at which droplets can be generated with precision. Outside this range, which is determined empirically, the formation of droplets becomes irregular. Thus, a diameter that is chosen to meet the droplet size and fluid flow constraints discussed above may not operate properly because the number of droplets which should be generated to result in the proper amount of binding agent being applied may require a droplet frequency beyond the range at which regular droplet formation can be achieved. In such circumstances, the diameter of orifice 306 can be increased until the fluid flow rate becomes sufficient to sustain regular droplet formation at the chosen droplet frequency.

The value of the diameter of orifice 306 set forth above, as well as that of other dimensions and parameters of the apparatus shown in FIG. 3, some of which are set forth below, were determined by an empirical process. From the above discussion, it is of course to be appreciated by a person of skill in the art that these preferred values, and many other described aspects of the apparatus, as well as the structure of the apparatus, can be varied without departing from the spirit of the present invention. For example, an apparatus having multiple jets may be used to generate droplet patterns.

Referring again to FIG. 3, glass tube 300 is encased by silver sleeve 302, the inner surface of which is fused onto the outer surface of glass tube 300. Piezoelectric crystals 110*a* and 110*b*, each shaped like a ring, having inner and outer diameters of 0.25 and 0.5 inch, respectively, are snugly fitted and glued onto silver sleeve 302. By so fusing silver sleeve 302 onto glass tube 300, and by so fitting and gluing crystals 110*a* and 110*b* onto sleeve 302, good mechanical coupling is achieved between the crystals and the glass tube.

Crystals 110*a* and 110*b* are approximately 0.3 inch thick, and are spaced approximately 0.25 inch apart. The crystals are formed from a high voltage grade ceramic material having piezoelectric properties, and each has a metallized surface 306 to which is soldered a high voltage wire lead 308 from the secondary winding of step-up transformer 156. A second wire lead 310 from the secondary winding of transformer 156 is soldered to silver sleeve 302, such that when a clock signal is generated by master clock 150, a sine wave drive signal is imposed on the crystals. This drive signal typically has a magnitude in the range of 1000–2000 volts peak-to-peak. The electric field established across crystals 110*a* and 110*b* causes the crystals to expand and contract in response to changes in the voltage of the drive signal, and, because of the mechanical coupling between the crystals and glass tube 300, thereby induces pressure variations in the adhesive solution conducted by glass tube 300. Glass tube 300 electrically isolates the drive signal from the adhesive solution to prevent grounding of the drive signal. Such electrical isolation of course may be achieved by using electrically non-conductive materials other than glass to conduct the adhesive solution.

Charging tunnel 112 is a cylindrical metal tube having an inner diameter of approximately 0.12 inch and a length of approximately one inch. Charge voltage is applied to charging tunnel 112 by jet control circuit 111 via wire 312. The charge voltage, which typically varies between 0 and 300 volts, creates an electric field in the hollow interior of charging tunnel 112 that causes droplets to become negatively charged as they break from the stream of adhesive solution. The charge on any particular droplet is proportional in magnitude to the instantaneous strength of the electric field at the location and time that the droplet separates from the stream. Although the exact location of break-off may vary slightly from droplet to droplet, the cylindrical shape of charging tunnel 112 causes the electric field created in its interior to be substantially uniform along the length of the tunnel, such that minor variations in the location of the break-off point do not substantially vary the charge applied to the droplets. Variations in the timing of break-off are compensated by varying the timing of the charging voltages, as further described herein.

Deflection plates 113*a* and 113*b* are connected respectively to the positive and ground terminals of a conventional high voltage power supply 160 that maintains plate 113*a* at a constant voltage in the range of 5000–7000 volts above ground. Deflection plates 113*a* and 113*b* are approximately 6 inches in length and are positioned parallel to one another approximately 0.245 inch apart. An air gap of approximately 0.5 inch between charging tunnel 112 and deflection plates 113*a* and 113*b* prevents an electrical short between the tunnel and the plates. The voltage differential between the plates creates an electric field that causes the charged droplets to be deflected toward plate 113*a* as they pass between the plates. Deflected droplets travel a distance of approximately 4 inches after exiting the deflection plates before they contact the end of a cigarette as it passes through target area 134.

Gutter 114 is located approximately 0.5 inch beyond the ends of deflection plates 113*a* and 113*b*. Droplets entering gutter 114 strike inner surface 322 which is positioned at a slight angle across the path of the entering droplets. Inner surface 322 is made from a conductive material such as metal and comprises charge pickup electrode 136. The charges on the droplets that strike inner surface 322 are deposited on the metal, resulting in a current being conducted by wire 324 to jet control electronics 111. The angled inner surface may also be made of non-conductive material, such as plastic, in which case electric wire 324 should project in the gutter cavity to pick up the electric charge. After striking inner surface 322, the droplets flow down vertical tube 326 to degassing tank 115. This vertical drop causes the flow of fluid between inner surface 322 and degassing tank 115 to be discontinuous, and thereby prevents the fluid from grounding charge pickup electrode 136.

Figure 4A:
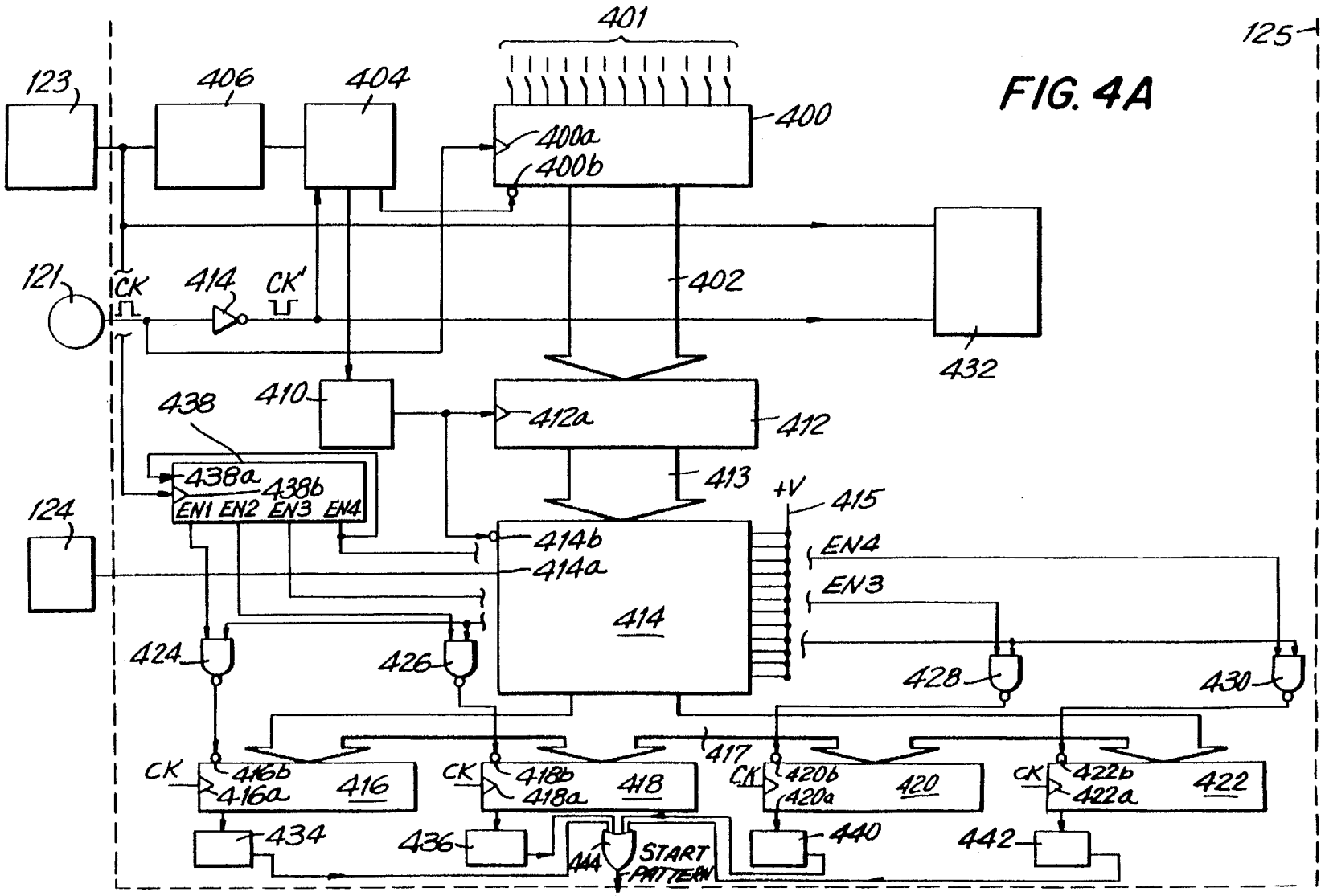
FIGS. 4A and 4B are schematics diagram of electronic control circuits 111 and 125 of FIG. 1.
Figure 4B:
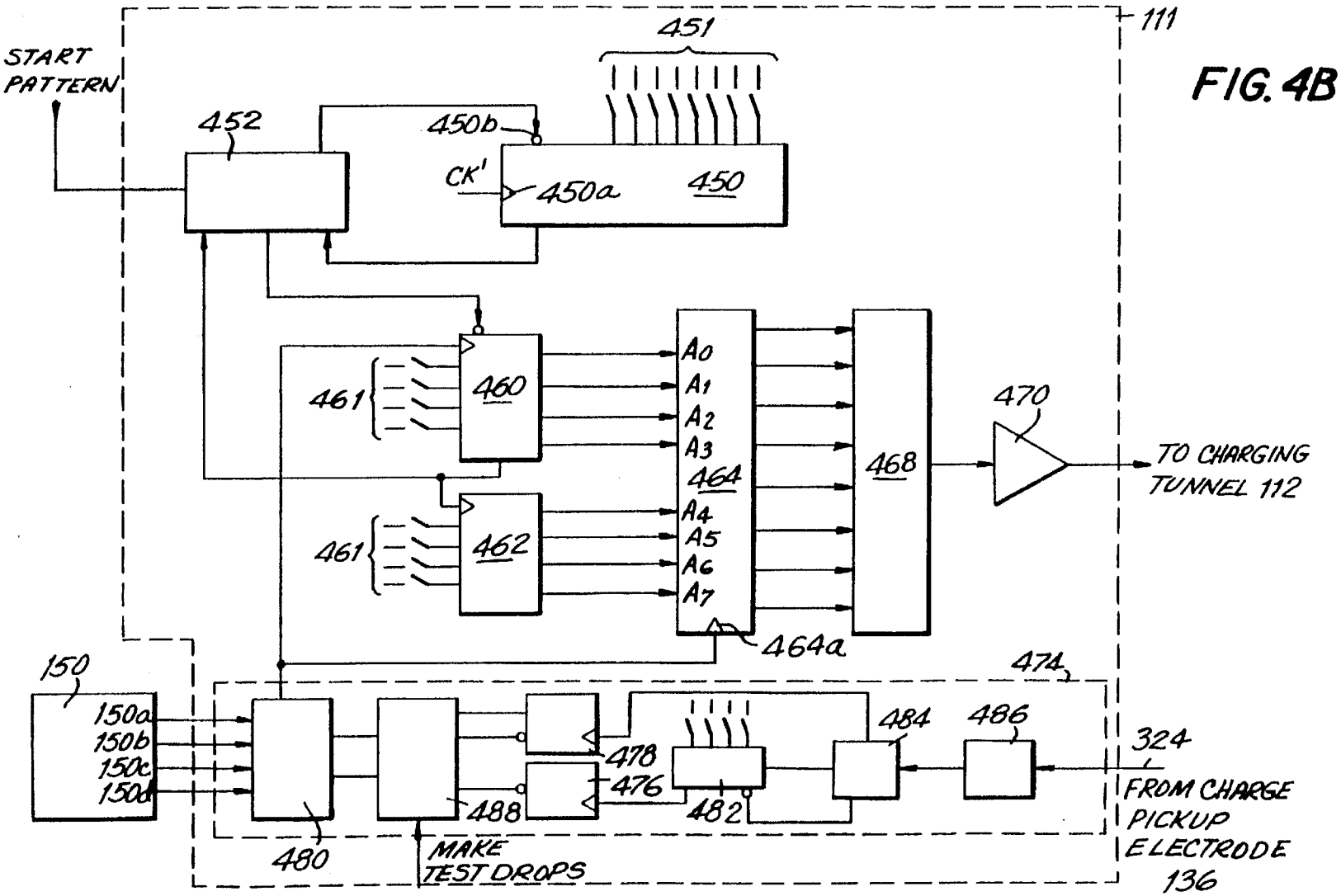

Referring now to FIGS. 4A and 4B, preferred embodiments of circuits 111 and 125 of FIG. 1 are shown. The circuits can be implemented using conventional off-the-shelf electronic parts. Optical encoder 121 is adapted to generate a clocking signal which completes 10,000 clocking cycles for each revolution of drum 120. Each clocking cycle indicates that drum 120 has rotated 1/10,000 of a revolution. Greater or lesser resolution with respect to the rotation of drum 120 can be obtained, as desired, by adapting the encoder to generate more or less clocking cycles per revolution. The clocking signal generated by encoder 121 permits the control circuits to measure dynamically the rotation of drum 120, and to determine precisely the timing of the droplet charging voltages applied to charging tunnel 112 to ensure that droplets are charged in synchronization with the rotation of drum 120.

To synchronize the charging mechanism with the rotation of drum 120, the nozzle of jet 109 is fixed in a position such that, when drum 120 is rotating at its maximum speed, droplets which are charged in response to the detection by sensor 123 of the presence of a cigarette will have sufficient time to reach the predetermined target area 134 at the same time that the detected cigarette reaches the same location. This position is calculated by first determining the "lead time" required for a droplet to travel from the break-off point in charging tunnel 112 to target area 134, and then multiplying that value by the maximum angular velocity of drum 120. For example, a typical drum may rotate a maximum of 8,000 cigarettes through target area 134 per minute. In a typical embodiment of the present invention, a droplet travels 0.28 meters from break-off to the selected target area at a velocity of 14.4 meters/second, such that it takes the droplet 0.019 seconds to reach its destination. At a speed of 8,000 cigarettes/minute, a drum, which typically holds 54 cigarettes, will require a maximum "lead angle" of 16.89°—that is, there must be 16.89° arc between the position of sensor 123 and target area 134 to permit droplets to travel the required distance from break-off to target area 134 in the time it takes a cigarette traveling at maximum speed to go from sensor 123 to target area 134.

The distance from charging tunnel 112 to target area 134 is fixed, and the velocity of the droplets is constant. However, because the rotational speed of drum 120 may drop below its maximum value, the actual lead time required to synchronize the arrival of the droplets at target area 134 with the arrival of the cigarette detected by sensor 123 may be less than the maximum lead time value calculated above. The varying speed of the drum necessitates "leading" the target area by different angles. This requires that the speed of the drum be used to determine the correct lead angle to target area 134, and that the lead angle be measured dynamically. This is accomplished by optical shaft encoder 121 and the circuitry shown in FIGS. 4A and 4B.

Compensation for the disparity between a constant droplet flight time and variable drum speed is accomplished by loading 12-bit flight time counter 400 of circuit 125 shown in FIG. 4A, which can be implemented using three conventional 4-bit synchronous up down counter circuits connected as down counters in a conventional cascaded configuration, with a number representing, in terms of counts of encoder 121, the angular offset between sensor 123 and target area 134.

Counter 400 has 12 data inputs, each of which is connected to a switch 401. The positions of the switches determine the number to be loaded into counter 400. Counter 400 has two modes of operation: load and count. When in its load mode, counter 400 reads the status of switches 401 and stores the number represented by the switches. This load operation occurs in response to a clock signal being applied to clock input 400*a* of counter 400. When counter 400 is in its count mode, the value stored in counter 400 is decremented once for each cycle of the clock signal applied to clock input 400*a*, and the decremented value is placed on a 12-bit wide data bus 402. Clock input 400*a* is connected to optical encoder 121, which generates a clock signal CK based on the rotation of drum 120.

The mode of counter 400 is controlled by flight time circuit 404, which is connected to mode select pin 400*b* of counter 400. Flight time circuit 404 includes a conventional adjustable one-shot logic circuit. The one-shot logic circuit is adjusted to have a time-out period equal to the flight time of droplets traveling from the break-off point in charging tunnel 112 to target area 134. The time-out period of the one-shot logic circuit is triggered by divide-by-8 counter circuit 406, which detects pulses generated by optical sensor 124 and provides a triggering signal to the one-shot logic circuit coincident with every eighth pulse that it detects. A pulse is generated by optical sensor 123 each time it senses a slot in slotted disk 122 corresponding to a groove in the periphery of drum 120. Divide-by-8 counter circuit 406 can be implemented in a conventional manner using a series of three flip-flop logic circuits each configured conventionally as a divide-by-2 counter. Alternatively, two of the flip-flop logic circuits can be replaced by a 4-bit shift register, such as the one used to implement register 438 described below.

During operation, flight time circuit 404 causes counter 400 to load the number represented by switches 401 on the first cycle of clock signal CK. Counter 400 continues to reload the same number on each cycle of clock signal CK until sensor 123 has detected the passage of eight slots, at which time divide-by-8 counter circuit 406 triggers the time-out period of the one-shot logic circuit of flight time circuit 404. When the one-shot is triggered, flight time circuit 404 causes counter 400 to enter its count mode and to begin decrementing the value stored in the counter once for each cycle of clock signal CK. After the time-out period of the one-shot logic circuit expires, flight time circuit 404 provides a signal to pulse circuit 410. In response, pulse circuit 410 provides a clock pulse of short duration to clock input 412*a* of 12-bit holding register 412, which causes holding register 412 to read data bus 402 and store the value that remains in counter 400 after the time-out period of the one-shot logic circuit expires. Holding register 412 can be implemented using three conventional 4-bit latched-output registers connected in a conventional parallel configuration. Pulse circuit 410 can be implemented using a conventional adjustable one-shot logic circuit adjusted to have a time-out period of approximately one microsecond.

Counter 400 requires a short time period after each cycle of clock signal CK in which to generate a stable output on data bus 402. A second clock signal CK', which is 180° out of phase from clock signal CK, is used to time changes in the output of flight time circuit 404 to ensure that the value on data bus 402 is stable when read by holding register 412. Clock signal CK' is generated by inverter 414 from clock signal CK. Synchronization of the transition in the output of flight time circuit 404 with clock signal CK' is accomplished by using a conventional flip-flop logic circuit, clocked by clock signal CK', to gate the output of flight time circuit 404. In this manner, the output of flight time circuit 404 changes between cycles of clock signal CK, such that pulse circuit 410 is triggered by flight time circuit 404 only when the output of counter 400 is stable.

The remainder value transferred from counter 400 to holding register 412 represents the angle of rotation, in terms of counts of encoder 121, by which the actual lead angle differs from the maximum lead angle. This remainder, which is dependent upon the instantaneous rotational speed of drum 120, determines how long after a cigarette has been detected by sensor 124 that voltages are to be applied to charging tunnel 112 to generate a pattern of droplets for that cigarette, and is recalculated as often as possible. The frequency with which this calculation can be made is determined by the flight time of the droplets, since that time period is used to decrement counter 400. In a typical embodiment, between four and eight slots pass by sensor 123 during the same period. The remainder is therefore recalculated once every eight cigarettes in response to the signal provided by divide-by-8 counter circuit 406.

By placing the remainder value in a register and decrementing that register once for each cycle of clock signal CK occurring after a cigarette is detected by sensor 124, a signal generated by the register indicating that it has counted down to zero can be used to time the charging voltage for the first droplet in the pattern for the detected cigarette. However, sensor 124 may detect one or more other cigarettes during the time that the register is counting, thereby requiring additional registers to time the start of patterns for these cigarettes. This is accomplished by using four 12-bit counters 416, 418, 420 and 422 which are loaded with the current remainder stored in holding register 412 in a round robin fashion each time a cigarette is sensed by sensor 124. Counters 416, 418, 420 and 422 can each be implemented using three 4-bit synchronous up/down counter circuits in the same manner as counter 400.

The output of sensor 124 is provided to the data select input 414*a* of data multiplexer 414. Data multiplexer 414 has two sets of 12-bit data inputs, and can be implemented using three conventional 4-bit data multiplexer circuits connected in parallel. One set of inputs is connected to a corresponding set of outputs from holding register 412 to form data bus 413. The other set of inputs is connected to a reference voltage supply 415, which causes the value FFF hexadecimal to be present at the inputs. Data multiplexer 414 selects the data present on one of the two sets of inputs and transfers the selected data to data bus 417. The data to be selected is determined by the output of sensor 124. When sensor 124 detects a cigarette, sensor 124 generates an output signal that causes data multiplexer 414 to transfer the value of holding register 412 to data bus 417. When no cigarette is detected, sensor 124 causes data multiplexer 414 to transfer FFF hexadecimal to data bus 417.

The data on data bus 413 is in a state of transition during the short period of time that holding register 412 is reading the output of counter 400. To prevent data multiplexer 414 from transferring data from data bus 413 to data bus 417 during this period, the output of pulse circuit 410 is connected to enable pin **414*b* of data multiplexer 414. When flight time circuit 404 triggers pulse circuit 410 to generate a short pulse to transfer the remainder value from counter 400 to holding register 412, the same short pulse prevents data multiplexer 414 from changing the data on data bus 417 in response to any change in the data on data bus 413** occurring during the short pulse.

Data bus 417 is connected to the data inputs of counters 416, 418, 420 and 422. Clock signal CK is provided to clock inputs **416*a*, 418*a*, 420*a* and 422*a* of the counters. The operating modes of counters 416, 418, 420 and 422 are controlled individually by conventional dual input NAND gate logic circuits 424, 426, 428 and 430, the outputs of which are connected respectively to mode select pins 416*b*, 418*b*, 420*b* and 422*b*. A first input of each NAND logic circuit is connected respectively to one of four outputs EN1–EN4 of a conventional 4-bit shift register 438. Output EN4, corresponding to the most significant bit of register 458, is also connected to data input 438*a* of register 438 to provide a continuous shift of a single binary data bit through the register. The clock input 438*b* of register 438 is connected to the output of sensor 123. When sensor 123 detects a slot on slotted disk 122, register 438 provides an enable signal to one of the four NAND gates. On each subsequent detection of a slot by sensor 123** the enable signal is provided to a different NAND gate, such that each NAND gate receives an enable signal once every four slots.

The second input of each NAND gate is connected to the output of synchronization circuit 432. Synchronization circuit 432 comprises a pair of conventional flip-flop logic circuits connected in a conventional manner to synchronize the output of sensor 123 with clock signal CK', both of which signals are provided as inputs to synchronization circuit 432. Such synchronization compensates for differences in timing between the output of sensor 123 and clock signal CK' that may arise as a result of the alignment of slotted disk 122 on drum 120. When a slot is sensed by sensor 123, synchronization circuit 432 generates a pulse coincident with a cycle of clock signal CK'. This pulse is provided to the second input of NAND gates 424, 426, 428 and 430. As described above, register 438 provides an enable signal to the first input of one of the NAND gates. In response to the simultaneous occurrence of a pulse from synchronization circuit 432 and the enable signal from register 438, the enabled NAND gate causes its corresponding counter, one of counters 416, 418, 420 and 422, to load the data on data bus 417. In this manner, one counter is loaded with a value each time a slot is detected by sensor 123. If a cigarette is detected simultaneously with a slot, a counter is loaded with the remainder value from counter 400. If a slot is sensed, but no cigarette is detected, then a counter is loaded with FFF hexadecimal.

The four counters are simultaneously decremented by clocking signal CK provided by encoder 121. When any of the four counters reaches zero, a start pattern signal is provided by the timed-out counter to a corresponding conventional flip-flop logic circuit 434, 436, 440 or 442, which synchronizes the start pattern signal with clock signal CK'. The synchronized start pattern signal is then provided to a conventional quad-input OR gate logic circuit 444 to activate the pattern generating circuitry of jet control circuit 111. Upon reaching zero, the timed-out counter is automatically reset to FFF hexadecimal on the next cycle of the clocking signal provided by encoder 121, and the decrementing process begins again, so that counters 416, 418, 420 and 422 are continuously decremented by the clocking signal, except when being loaded.

If a remainder value has been loaded into a counter in response to the detection of a cigarette by sensor 124, the counter is decremented to zero before being reloaded with the next round of timing information, and a start pattern signal is provided by the counter to activate the pattern generating circuitry of jet control circuit 111, as described above.

If the enabled counter has been loaded with FFF hexadecimal in response to the detection of a missing cigarette, the counter has insufficient time to reach zero before being reloaded with the next round of timing information, and no pattern is generated for the missing cigarette.

A droplet pattern is comprised of a predetermined number of individual characters. For example, the 19 droplet pattern shown in FIG. 2 can be comprised of five characters, one character for each vertical column of droplets, although a different number of characters may also be used. For example, referring to FIG. 2, droplets 1–3 may comprise a first character, 4–7 a second character 8–12 a third character, 13–16 a fourth character, and 17–19 a fifth character. Alternatively, a 3 character pattern may be used in which droplets 1–6 comprise the first character, 7–13 comprise the second character, and 14–19 comprise the third character. The droplet columns are skewed by the motion of the cigarette across the target area during generation and application of the pattern. The timing of the individual characters is adjusted according to the speed of drum 120 by using clock signal CK' to measure the period between the generation of the series of charge voltages for each character, so that the spacing of the pattern across the cigarette remains substantially constant as the drum speed varies. This adjustment is accomplished by character space counter 450 of circuit 111 shown in FIG. 4B, which is loaded at the start of each pattern with a value representative of the proper spacing between characters.

Character space counter 450 is an 8-bit counter circuit which can be implemented by connecting two conventional 4-bit counter circuits, such as those described above in connection with counters 400, 416, 418, 420 and 422, in a conventional cascaded configuration. Clock signal CK' is provided to clock input **450*a* of character space counter 450. The mode of counter 450 is controlled by synchronization logic circuit 452 connected to mode select pin 450*b*. Synchronization logic circuit 452 can be implemented using conventional digital logic circuits. During operation, synchronization logic circuit 452 causes counter 450 to load an 8-bit number representing, in counts of encoder 121, the desired space between characters in a pattern. A switch 451** is connected to each data input of counter 450 and is positioned according to the number to be loaded into counter 450. The load operation occurs on the first cycle of clock signal CK', and is repeated on each subsequent cycle of clock signal CK' until a start pattern signal is generated by timing control circuit 125. In response to a start pattern signal, synchronization logic circuit 452 causes counter 450 to enter its count mode and to begin decrementing the value stored in counter 450 once for each cycle of clock signal CK'. When counter 450 is decremented to zero, a signal is generated by synchronization logic circuit 452 that causes row address counter 460, comprising a conventional 4-bit counter circuit, to enter a count mode. Synchronization logic circuit 452 also causes character space counter 450 to be reloaded with the number represented by switches 451 after it has been decremented to zero.

Row address counter 460 and column address counter 462, which is also a conventional 4-bit counter circuit, supply values respectively to address lines A0 through A3 and line A4 through A7 of a conventional programmable read-only memory (PROM) circuit 464. These values are used to select a particular memory location in PROM 464 containing digital data representative of the value of the voltage which is to be applied to charging tunnel 112. Each memory location in PROM 464 stores 8 bits of data. The memory locations are grouped according to the type of pattern to be generated. For example, if the droplet pattern of FIG. 2 is to be generated from 5 characters, each corresponding to a column of droplets, then the memory locations are grouped into 5 columns each having 6 rows of consecutive memory locations. Each column of consecutive memory locations contains the pattern information for a single character. One of the four clock signal phases generated by master clock 150 is provided to clock input 460*a* of counter 460 by phase determination and switching subsystem 474. For each cycle of master clock 150 occurring after counter 450 reaches zero, the value in row address counter 460 is decremented by one and its current value, pointing to the next consecutive memory address of PROM 464 within the column pointed to by column address courter 462, is placed on lines A0 through A7. The output of master clock 150 is provided to clock input 464*a* of PROM 464 to cause PROM 464 to provide the data contents of the selected memory location to a conventional 8-bit digital-to-analog converter (DAC) 468 on data lines D0 through D7. DAC 468 converts the digital data on data lines D0–D7 to an analog signal which is amplified by a conventional amplifier circuit 470 and provided to charging tunnel 112 to charge the droplets emerging from jet 109.

The row and column address of the memory location in PROM 464 at which the data for a particular pattern begins is loaded into counters 460 and 462 on the first cycle of master clock 150. The value to be loaded is determined by the positions of switches 461 connected to the data inputs of counters 460 and 462. The counters are reloaded with the same value on every subsequent cycle of master clock 150 until character space counter 450 is decremented to zero. The contents of the memory location in PROM 464 addressed by switches 461 is continuously converted by DAC into a charge voltage during this same period. Meanwhile, droplets are being formed in charging tunnel 112. To avoid the untimely charging of droplets between patterns, the memory location in PROM 464 corresponding to the address on switches 461 contains data that results in zero charge voltage being applied to charging tunnel 112.

When row address counter 460 is decremented to zero, signalling the completion of a character, a terminal count signal is provided to clock input 462*a* of column address counter 462 which decrements the value in counter 462 and causes its current value to be placed on address lines A4 through A7. This new value points to the next consecutive column of memory locations in PROM 464, which contains charging data for the next character in the pattern. At the same time, the terminal count signal from counter 460 is provided to synchronization logic circuit 452 which causes row address counter 460 to enter a load mode and to reload the value on switches 461. The memory location in PROM 464 addressed by counters 460 and 462 at this time corresponds to the first memory location in the second column of locations in PROM 464. This location, like the first location in each of the subsequent columns of memory locations that determines the voltage on charging tunnel 112 while character space counter 450 is counting the spacing between characters in the pattern. These locations therefore contains data corresponding to a zero charge voltage. When character space counter 450 is again decremented to zero, charge voltages for the second column of droplets in the pattern are generated. This process is repeated until the voltages for all of the characters in the pattern are generated. In this manner, proper spacing is maintained between characters in the pattern at different drum speeds.

Master clock 150 can be implemented using a conventional adjustable oscillator circuit adjusted to generate a clock signal having a frequency several times greater than the desired frequency of droplet formation. From this signal, conventional digital logic circuits can be used to generate the clock signals provided to low pass filter circuit 152 and jet control electronics 111.

Phase determination and switching subsystem 474 determines which of the four possible charging phases of master clock 150 is to be used by jet control electronics 111 to time droplet charging. Subsystem 474 includes two conventional two-bit storage registers 476 and 478, a conventional 4-bit data multiplexer circuit 480, a conventional 4 line to 2 line data selector circuit 488, and a conventional 4-bit synchronous up/down counter circuit 482. The four phases of master clock 150 are provided to the data inputs of data multiplexer circuit 480, one of which signals is selected by data multiplexer circuit 480 in accordance with the output of data selector 488. The phase number stored in register 476, referred to hereinafter as the working phase, is used to generate patterns. The phase number stored in register 478, referred to hereinafter as the test phase, is used to generate test droplets. The phase number used by multiplexer 480 is switched between the working phase number and the test phase number by data selector 488 in response to a "make test drops" signal. The working phase number is determined as follows.

Register 478 contains a second phase number, referred to hereinafter as the test phase, that is used to select one phase of master clock 150 to time the charging of test droplets. When a test is to be conducted, the charging phase selected by data multiplexer circuit 480 is switched to the test phase stored in register 478, a series of droplets is charged to a low level, and a conventional one-shot logic circuit 484 is triggered. The purpose of one-shot 484 is to allow time for the test charges to reach charge pickup electrode 136 in gutter 114. The delay period of one-shot 484 is set accordingly. When one shot 484 times out, the output of a conventional charge level threshold detector circuit 486 connected to charge pickup electrode 136 is sampled. If the test phase results in adequate charging, counter circuit 482 is loaded with the value 16, and a new test phase is loaded into register 478. If the original test phase results in poor charging, the test phase is not changed, and the value of counter circuit 482, which is initially loaded with the value 16, is decremented by one. This cycle is repeated as often as possible. In a typical embodiment, test charges are generated after every other droplet pattern. If at some time counter circuit 482 reaches zero, indicating that a particular test phase has resulted in poor charging in 16 consecutive tests, a new working phase representing the phase 180° from the bad test phase is loaded into register 476. This new working phase thus determines which phase of master clock 150 is to be used to charge droplets. The above described phase determination scheme is preferred because it has been determined that the most reliable method of finding the optimum charging phase is to locate the worst phase and to use the phase 180° away from that phase.

Thus, a method and apparatus for applying an adhesive solution to the end of a cigarette has been disclosed. One skilled in the art will appreciate that the present invention can be practiced by other than the described embodiments, which are presented for purposes of illustration and not of limitation, and the present invention is limited only by the claims which follow.

What is claimed is:

1. A method for applying a predetermined pattern of droplets of a fluid to an end of each of a series of cigarettes occupying at least some of a series of grooves located around the circumference of a cigarette drum having a variable rate of rotation, the fluid being capable of accepting an electric charge, the method comprising the steps of:

(a) generating a series of droplets of fluid;

(b) passing the series of droplets in the vicinity of a charging electrode;

(c) detecting incremental rotational movement of the cigarette drum;

(d) generating a clocking signal in response to the detection of incremental rotational movement of the cigarette drum;

(e) detecting the presence of a cigarette in a groove on the rotating cigarette drum as the groove passes a predetermined sensor location;

(g) applying the clocking signal to a control circuit to cause a series of voltages to be applied to the charging electrode at predetermined intervals after the cigarette drum has rotated a predetermined number of increments following detection of the presence of the cigarette, whereby a charge is applied to at least some of the series of droplets passing in the vicinity of the charging electrode; and (g) passing the series of droplets through an electric field to cause the charged droplets to be deflected at an acceleration in proportion to the charge on each droplet and to cause at least some of the charged droplets to contact the end of the detected cigarette in a predetermined pattern as the detected cigarette passes through a predetermined target location.

2. The method of claim 1, wherein the predetermined pattern of droplets comprises one or more characters, each character comprising one or more droplets, and wherein the series of voltages applied to the charging electrode comprises one or more sequential portions corresponding to the one or more characters, each portion comprising one or more voltages corresponding to the one or more droplets of the corresponding character, the portions corresponding to the characters of the predetermined pattern being applied to the charging electrode at a first predetermined interval, and the voltages within each of the portions being applied to the charging electrode at a second predetermined interval.

3. The method of claim 2, wherein the first predetermined interval varies in proportion with changes in the rotational speed of the drum.

4. An apparatus for applying a fluid capable of accepting an electric charge to a cigarette having a coal end portion which contains tobacco shreds, the cigarette being located in a groove on the perimeter of a rotating drum defining a path of travel which is perpendicular to the longitudinal axis of the cigarette, the path containing a sensor location and a target location, the apparatus comprising:

a) a fluid supply connected to a nozzle to form a fluid stream, b) a vibrator which vibrates the nozzle to form droplets from the fluid stream, c) a droplet director for directing the droplets into the vicinity of a charging electrode, d) a voltage applicator connected to the charging electrodes which applies a series of voltages to the charging electrodes to cause a charge to be applied to at least some of the droplets, which applicator comprises i) a detector for detecting the presence of a cigarette on the drum as the cigarette passes the sensor location, ii) a start pattern signal generator which generates a start pattern signal beginning a period of time after the detected cigarette passes the predetermined sensor location, the period of time being equal in duration to the difference between the time required for the drum to move the detected cigarette from the sensor location to the target location and the time one of the series of droplets to travel from the point at which the droplets break from the fluid stream to the target location, and iii) a sequential voltage applicator which applies a sequential series of voltages of predetermined magnitudes to the charging electrodes at predetermined intervals in response to the start pattern signal to cause at least some the droplets passing in the vicinity of the charging electrode to be in proportion to the magnitude of the voltage applied to the charging electrode, and e) an electric field generating accelerator which deflects the charged droplets towards the target location in proportion to the charge on each droplet.

5. The apparatus of claim 4, wherein at least some of the predetermined time intervals vary in proportion to changes in the rotation and speed of the drum.

6. An apparatus for applying a predermined pattern of droplets of a fluid to an end of each of a series of cigarettes occupying at least some of a series of grooves located around the circumference of a cigarette drum having a variable rate of rotation, the fluid being capable of accepting an electric charge, the apparatus comprising:

(a) means for generating a series of droplets of fluid;

(b) means for passing the series of droplets in the vicinity of a charging electrode;

(c) means for detecting incremental rotational movement of the cigarette drum;

(d) means for generating a clocking signal in response to the detection of incremental rotational movement of the cigarette drum;

(e) means for detecting the presence of a cigarette in a groove on the rotating cigarette drum as the groove passes a predetermined sensor location;

(f) means for applying the clocking signal to a control circuit to cause a series of voltages to be applied to the charging electrode after the cigarette drum has rotated a predetermined number of increments following detection of the presence of the cigarette, whereby a charge is applied to at least some of the series of droplets passing in the vicinity of the charging electrode; and (g) means for passing the series of droplets through an electric field to cause the charged droplets to be deflected at an acceleration in proportion to the charge on each droplet and to cause at least some of the charged droplets to contact the end of the detected cigarette in a predetermined pattern as the detected cigarette passes through a predetermined target location.

7. The apparatus of claim 6, wherein the predetermined pattern of droplets comprises one or more characters, each character comprising one or more droplets, and wherein the series of voltages applied to the charging electrode comprises one or more sequential portions corresponding to the one or more characters, each portion comprising one or more voltages corresponding to the one or more droplets of the corresponding character, the portions corresponding to the characters of the predetermined pattern being applied to the charging electrode at a first predetermined interval, and the voltages within each of the portions being applied at a second predetermined interval.

8. The apparatus of claim 7, wherein the first predetermined interval varies in proportion with changes in the rotational speed of the drum.

9. A method for applying a fluid capable of accepting an charge to at least a portion of a coal end of a cigarette containing shreds, comprising the steps of:

a) forming a series of droplets of the fluid, b) applying a charge of controllable magnitude to at least some of the droplets, c) accelerating the charged droplets in proportion to the magnitude of the charge on each of the charged droplets to cause the charged droplets to contact at least a portion of the tobacco shreds at the coal of the cigarette in a predetermined pattern comprising a series of columns of various heights forming a substantially solid circular array droplets covering at least a substantial portion of the tobacco shreds the coal end of the cigarette.

10. A method for applying a fluid which is capable of electric charge to at least a portion of a coal end of a cigarette tobacco shreds, the cigarette being located in a groove on a perimeter rotatable drum, the rotation of the drum defining a predetermined path along which the cigarette moves in a direction perpendicular to the longitudinal axis of the cigarette, which path intersects a sensor and a target location, comprising the steps of:

a) supplying the fluid to a nozzle to cause a stream of fluid to emerge from the nozzle, b) vibrating the nozzle to cause the stream of fluid to break up a series of droplets, c) directing the droplets into the vicinity of a charging electrode, d) detecting the presence of a cigarette on the drum as the passes a sensor location, e) generating a start pattern signal beginning a period of time after the detected cigarette passes the sensor location, the period of time equal in duration to the difference between the time required for the to move the detected cigarette from the sensor location to the target location and the time required for one of the series of droplets to from the point at which the droplets break from the fluid stream to the target location, f) sequentially applying a series of voltages of magnitudes to the charging electrodes at predetermined intervals in response to the start pattern signal to cause at least some of the passing in the vicinity of the charging electrode to be charged in proportion to the magnitude of the voltage then applied to the g) passing the charged droplets through an electric field to cause charged droplets to be deflected toward the target location at an acceleration in proportion of the charge on each droplet, wherein the timing of the voltages is synchronized with the movement of the along the predetermined path to cause at least some of the deflected charged droplets to contact the cigarette in a predetermined pattern as the cigarette moves across the target location.

11. The method of claim 10 wherein at least some of the predetermined time intervals vary in proportion to changes in the rotational speed of the drum.

* * * * *